US006602051B2

(12) United States Patent
Fujinaka

(10) Patent No.: US 6,602,051 B2
(45) Date of Patent: Aug. 5, 2003

(54) BLOWING APPARATUS

(75) Inventor: Hiroyasu Fujinaka, Moriguchi (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/833,583

(22) Filed: Apr. 13, 2001

(65) Prior Publication Data

US 2001/0041136 A1 Nov. 15, 2001

(30) Foreign Application Priority Data

Apr. 27, 2000 (JP) ..... 2000-127460

(51) Int. Cl.[7] ..... F04D 29/52
(52) U.S. Cl. ..... 415/222; 415/915
(58) Field of Search ..... 415/222, 228, 415/220, 208.1, 915; 417/423.14; 361/697

(56) References Cited

U.S. PATENT DOCUMENTS 2,176,324 A * 10/1939 Bretzlaff et al. ..... 415/121.2
4,353,680 A * 10/1982 Hiraoka et al. ..... 415/201
5,559,674 A * 9/1996 Katsui ..... 165/121

FOREIGN PATENT DOCUMENTS

JP 9-264300 10/1997

OTHER PUBLICATIONS

Resnick, Robert and David Halliday, Physics, 1966, John Wiley & Sons, Inc., Part 1, p. 370–375.*

* cited by examiner

*Primary Examiner*—Edward K. Look
*Assistant Examiner*—Kimya N. McCoy
(74) *Attorney, Agent, or Firm*—Parkhurst & Wendel, L.L.P.

(57) ABSTRACT

A blowing apparatus with improved energy efficiency, comprising: a circular wall formed at a distance from a blade end of a fan; a first region where an inner diameter is enlarged so that a clearance with the blade end becomes substantially wide, and a second region having a narrower clearance with the blade end and formed with a slit, both regions being on a suction side of the circular wall; and an air pocket portion provided between an outer circumference of the circular wall and an outer peripheral portion of the housing.

7 Claims, 10 Drawing Sheets

BLOWING APPARATUS

FIELD OF THE INVENTION

The present invention relates to a blowing apparatus.

BACKGROUND OF THE INVENTION

In recent years, high-density packaging of electric circuits has been increasingly used in correspondence with miniaturization and electronization of appliances. In association with this, exothermic density of such electronic appliances also increases, so that a blowing apparatus has been used for cooling the appliances.

In addition, for the purpose of reducing the cost of the appliance, there is a strong demand for reducing the cost of the blowing apparatus used in such an appliance.

As shown in FIG. 12, in a conventional blowing apparatus, a circular wall 2 is formed at a distance from a blade end of a fan 1, and under the blowing condition where a motor portion 3 is energized, the axial fan 1 rotates about a shaft 4 to generate an air flow 5 directed toward the discharge side from the suction side.

However, in the above blowing condition, the speed of the air flow becomes high at the back pressure side of the blade end, so that a low energy area is generated on the rear edge side of blade where the air flow is converted to the pressure energy under the influence of the secondary flow between blades. This area is easy to be damaged and most likely to cause separation of flow, so that there arises a problem that the air flow is separated from the blade surface, causing generation of vortex in the separation area, and which vortex increases the turbulent flow noise and deteriorates the noise level and air capacity-static pressure characteristics.

This phenomenon is frequently observed particularly in such a situation that when flow resistance (system impedance) is exerted on the discharge flow side, generation of leak vortex at the blade end increases so that the fan exhibits a stalling state.

In consideration of the above-described problems, it is an object of the present invention to provide a blowing apparatus exerting the performance which remarkably overcomes that of the conventional blowing apparatus, as well as having better productivity than the conventional blowing apparatus and thus having excellent cost performance.

SUMMARY OF THE INVENTION

A blowing apparatus according to the present invention comprises a circular wall formed at a distance from a blade end of a fan, the circular wall having a first region where an inner diameter is partially enlarged so that a clearance with the blade end on a suction side becomes substantially wide, and a second region where a clearance with the blade end is made narrow, wherein a terminal end of the second region is extended halfway on a discharge side, and an air pocket portion (11) having a certain capacity and opening toward the discharge side is formed between an outer circumference of the circular wall and an outer peripheral portion of the housing, thereby improving the characteristics of the blowing apparatus.

According to the present invention, it is possible to improve the characteristics of the blowing apparatus, as well as it is possible to improve the cost performance of the blowing apparatus by increasing productivity and realizing cost reduction.

In the first aspect, the present invention provides a blowing apparatus formed with a circular wall at a distance from a blade end of a fan and having a housing in which the circular wall and a boss portion to which a motor is to be fixed are integrally formed, wherein a terminal end of the circular wall is extended halfway on a discharge side and an air pocket portion having a certain capacity and opening toward the discharge side is formed between an outer circumference of the circular wall and an outer peripheral portion of the housing, so that it is possible to reduce noise and reduce production cost of the blowing apparatus.

Furthermore, with the blowing apparatus wherein the circular wall has a first region where the inner diameter is partially enlarged so that a clearance with the blade end becomes substantially wide on a suction side, and a second region where a clearance with the blade end is made narrower, it is possible to improve the blowing characteristic of the blowing apparatus.

Furthermore, with the blowing apparatus wherein a boss portion of the housing is connected to the circular wall and is not directly fixed to the outer peripheral portion of the housing or to an attachment hole portion, it is possible to reduce noise and oscillation of a machine under the condition that the blowing apparatus is attached to the machine.

In the second aspect, the present invention provides a blowing apparatus, wherein when defining total mass of a motor and fan as m (kg), spring constant between a boss portion and an attachment portion as k (N/m), and rotation number of motor as N (1/s), the housing is set so as to satisfy the following relation ship:

$$N > \frac{1}{2\pi}\sqrt{\frac{k}{m}}$$

It goes without saying that the second aspect is effectively combined so as to realize the effect of the first aspect of the invention.

In the third aspect, the present invention provides a blowing apparatus formed with a circular wall at a distance from a blade end of a fan and having a housing in which the circular wall and a boss portion to which a motor is to be fixed are integrally formed, wherein the circular wall is comprised of a first region where the inner diameter is partially enlarged so that a clearance with the blade end on the suction side becomes substantially wide, and a second region where the clearance with the blade end is made narrow, wherein the terminal end of the second region is extended halfway on the discharge side, an air pocket portion having a certain capacity and opening toward the discharge side is formed between the outer circumference of the circular wall and the outer peripheral portion of the housing, and the circular wall is formed with a slit allowing air communication between the inner circumference of the circular wall and the air pocket portion, so that it is possible to improve the blowing characteristics under the condition of relatively high static pressure.

Furthermore, by forming the housing by using a mold composed of only an upper and a lower cores, it is possible to realize improvement of productivity and cost reduction.

In the following, preferred embodiments of the present invention will be explained with reference to FIGS. 1 to 7.

EMBODIMENT 1

FIG. 1 show a blowing apparatus according to Embodiment 1. FIG. 1A is a side view, FIG. 1B is a front view, FIG. 1C is a section view and FIG. 1D is a detailed section view along the line X-X1 of the blowing apparatus.

Figure 1A:
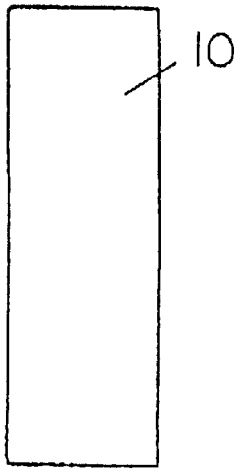
FIGS. 1A, 1B, 1C and 1D respectively show a side view, a front view, a section view and a detailed section view along line X-X1 of a blowing apparatus according to Embodiment 1 of the present invention.
Figure 1B:
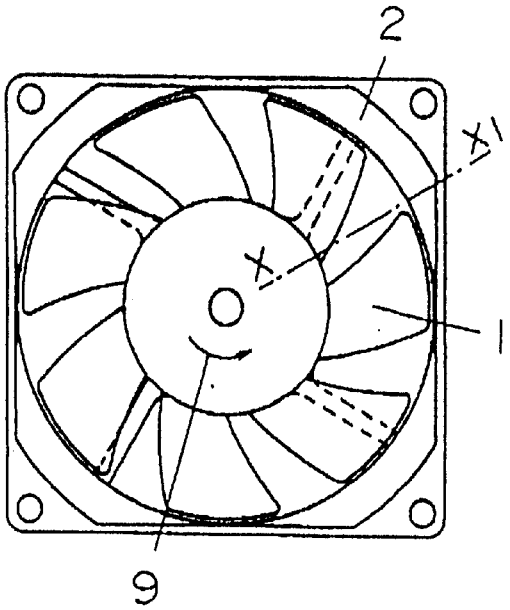
Figure 1C:
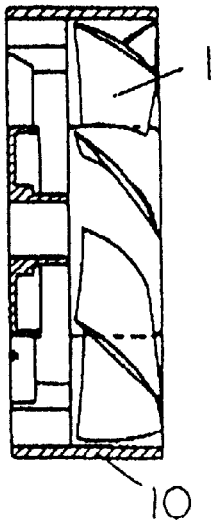
Figure 1D:
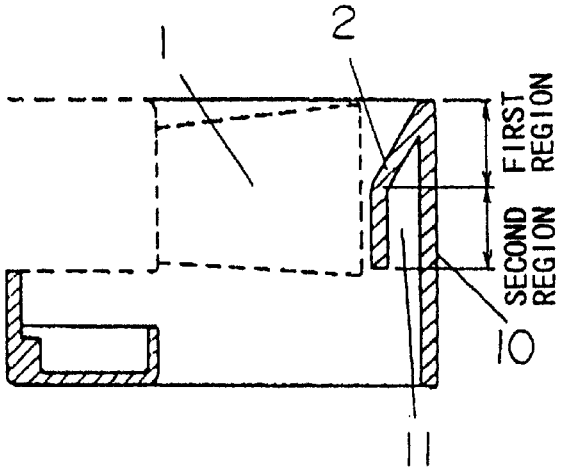

As shown in FIG. 1D, a circular wall 2 consists of a first region where the inner diameter is partially enlarged so that a clearance with a blade end of the suction side becomes substantially wide, and a second region where the clearance with the blade end is made narrow, and a terminal end of the second region is broken midway on the discharge side. Also between the outer circumference of the circular wall and a housing outer peripheral portion 10 is formed an air pocket portion 11 having a certain capacity.

The principle of this blowing apparatus will be explained with reference to FIGS. 2 and 3.

Figure 2:
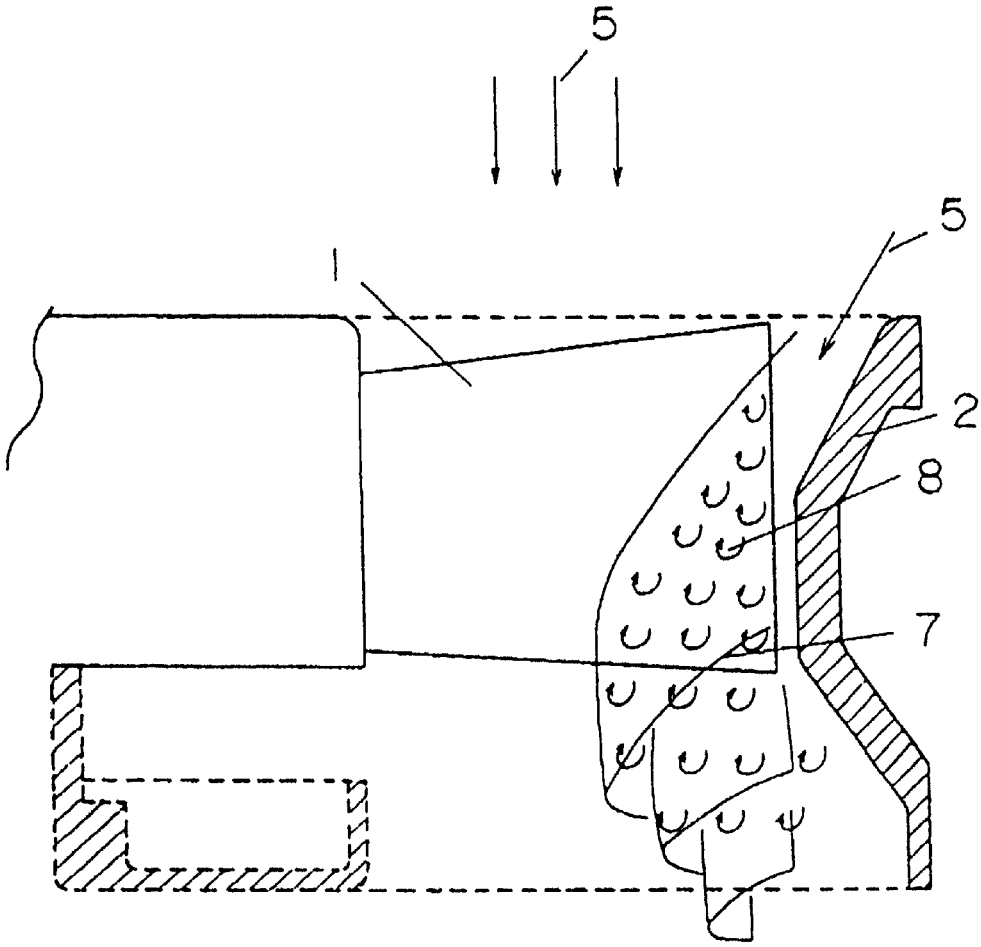
FIG.2 PRIOR ART
FIG. 2 is an explanatory view showing flow of air in a conventional blowing apparatus.

FIG. 2 shows the case where in the conventional blowing apparatus, the inner diameter of the profile on the suction opening side of the circular wall is enlarged so that the clearance with the blade end becomes wide.

With such a configuration, as the fan 1 is rotated in a rotation direction 9, an air flow 5 directed from the suction side to the discharge side is generated, and the air flow 5 is also sucked from the blade end portion, which is effective for increasing the air capacity particularly under the condition of low pressure compared to the case where the clearance is fixed.

In this portion, since the clearance with the blade end is wide, influence of the air viscosity is small and energy loss at the time of air inflow is small, so that it is possible to efficiently increase the air capacity.

Though by providing a portion where the inner diameter is enlarged, it is possible to increase the air capacity under the condition of low pressure, when used under the condition that a certain pressure is exerted, as shown in FIG. 2, a leak vortex flowing from the positive pressure side to the back pressure side at the blade end 7 grows to large extent, the air flow is separated from the blade surface, and a turbulent vortex 8 is generated in that separation area, with the result that turbulent flow and noise increase and the noise level and air capacity-static pressure characteristics are deteriorated.

This leak vortex at the blade end 7 does not grow too much on the suction side of the blade end 7, while on the other hand, it grows much in the area following the intermediate portion of the blade end to exert a large influence on the performance of the fan.

Figure 3:
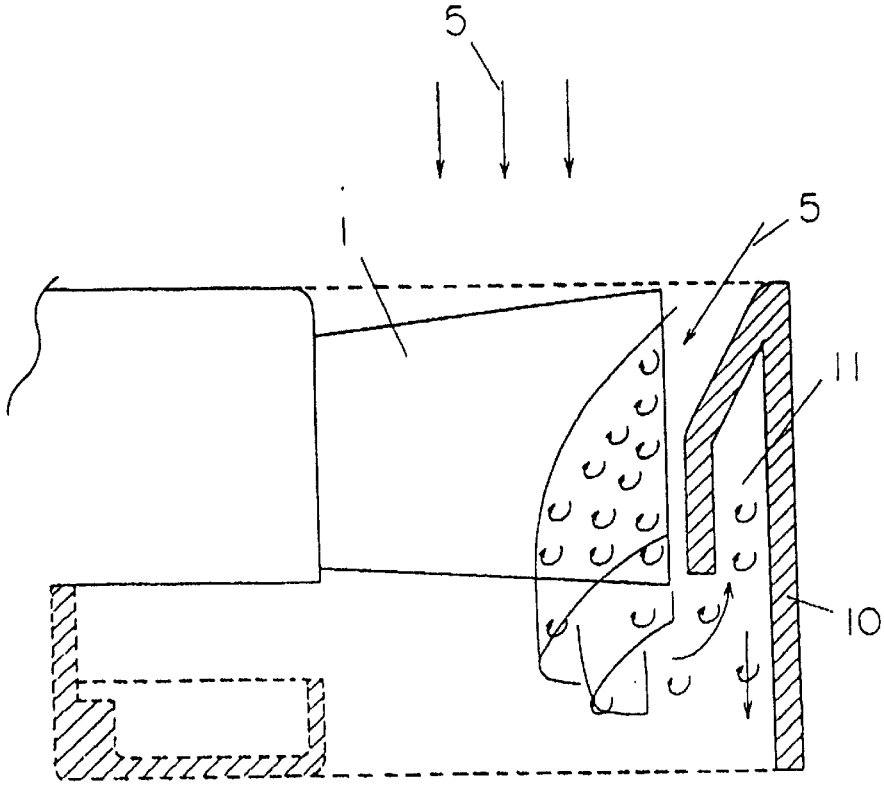
FIG. 3 is an explanatory view showing flow of air in the blowing apparatus according to the embodiment of the present invention.

FIG. 3 is an explanatory view showing flow of the air according to Embodiment 1 of the present invention.

In FIG. 3, by providing the air pocket portion 11 between the circular wall 2 and the housing outer peripheral portion 10 in the Embodiment 1 of the present invention, the leak vortex at the blade end 7 having grown in the area following the intermediate portion of the blade end is once sucked into the air pocket portion 11 on the discharge side of the fan 1, and the turbulent vortex 8 generated in this portion is discharged to the discharge side after being attenuated to a certain degree within the air pocket, making it possible to improve the noise level and the air capacity-static pressure characteristics (especially noise level).

Furthermore, the housing of the present blowing apparatus can significantly improve the productivity in comparison with the housing of the conventional blowing apparatus.

The reason of this will be described with reference to FIGS. 4 and 5.

Figure 4:
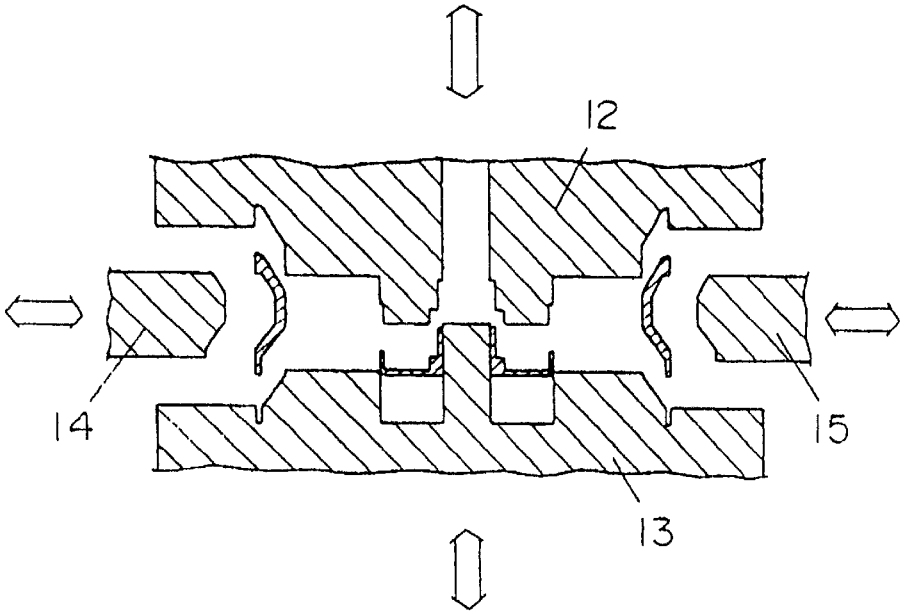
FIG. 4 PRIOR ART
FIG. 4 is a view showing a mold structure used in forming a housing of the conventional blowing apparatus.

FIG. 4 is a schematic view showing a structure of a mold for forming the housing of the conventional blowing apparatus.

In general, in the case of performing injection molding (or the like molding methods such as metal die casting and thixo-molding) and the like using resins or metals as a material, when the wall thickness of each part is significantly changed, the shape becomes uneven or a so-called sink is generated because of shrinkage of the material, so that it becomes difficult to keep the accuracy.

Therefore, in the case of forming a shape such as the housing of the conventional blowing apparatus, the shape of the housing is designed to have a recess portion on the outer circumference so that the entire wall thickness is substantially equal, and as shown in FIG. 4, it is common to use a mold structure consisting of an upper and a lower cores 12, 13 and two sliding cores 14, 15 which slide oppositely in the direction perpendicular to the upper and lower cores 12, 13.

Figure 5:
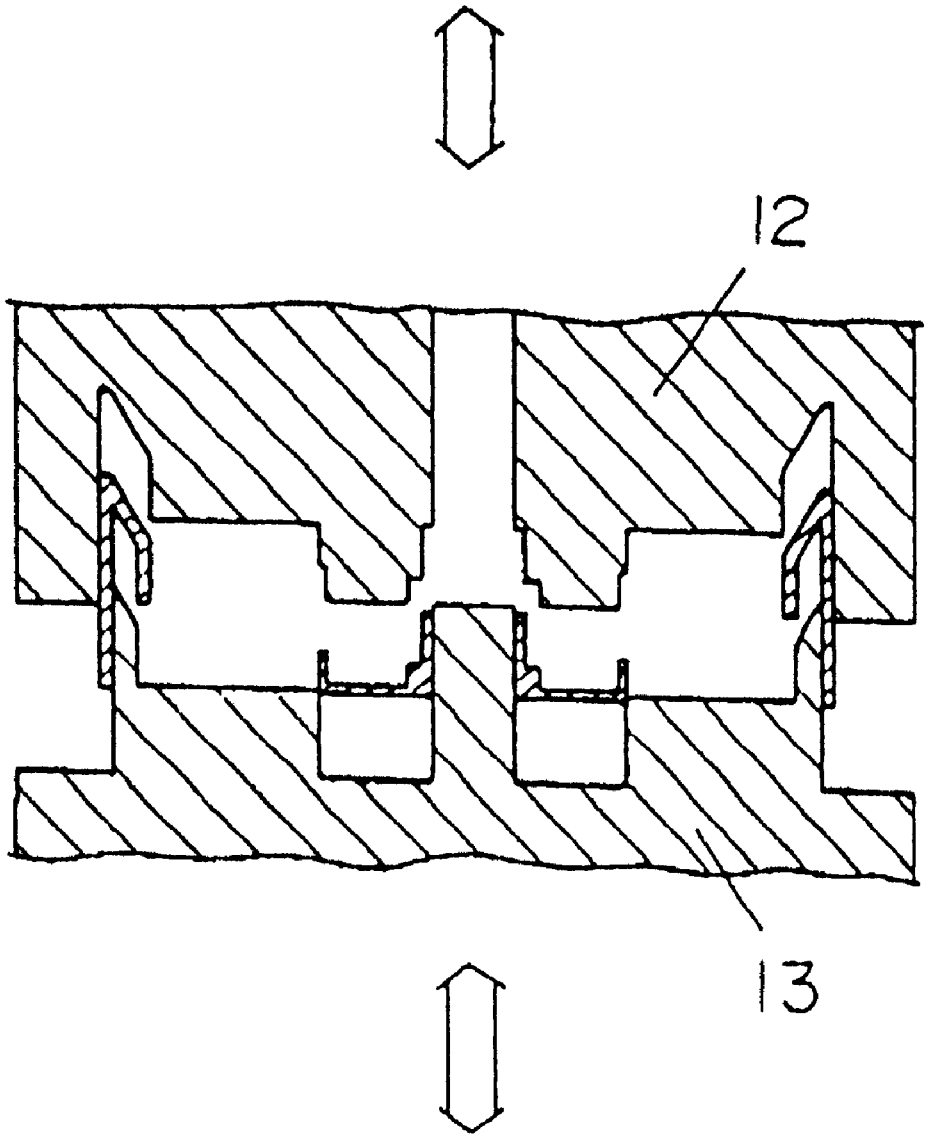
FIG. 5 is a view showing a mold structure used in forming a housing of the blowing apparatus according to the embodiment of the present invention.
Figure 6A:
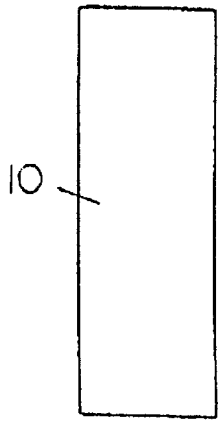
FIGS. 6A, 6B, 6C and 6D respectively show a side view, a front view, a section view and a detailed section view along line X-X1 of a blowing apparatus according to Embodiment 2 of the present invention.
Figure 6B:
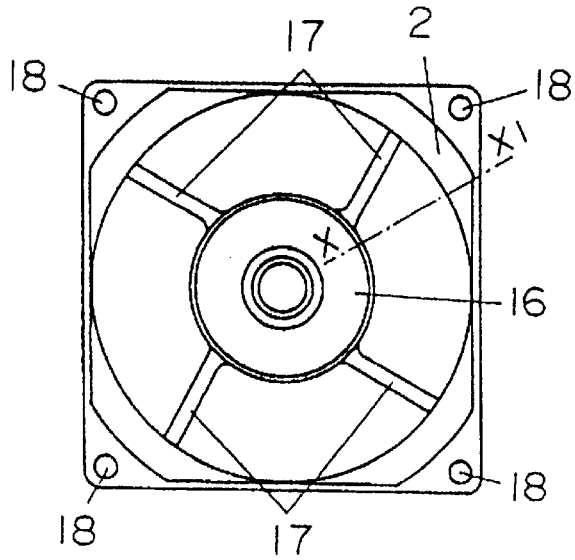
Figure 6C:
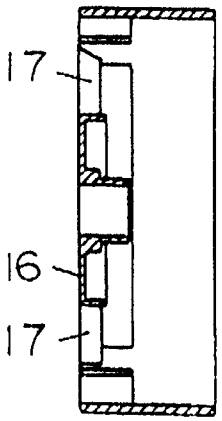
Figure 6D:
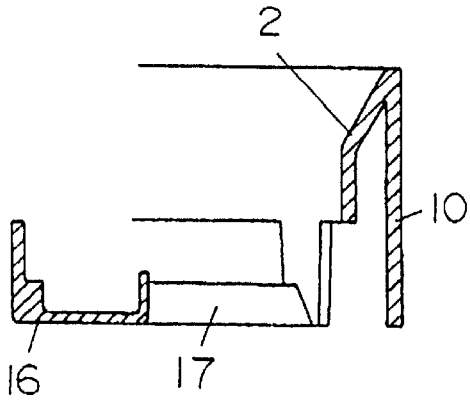

FIG. 5 shows a mold structure for forming the housing of the blowing apparatus according to Embodiment 1 of the present invention.

In FIG. 5, the housing according to Embodiment 1 of the present invention is formed by a mold which is configured by combination of simple upper and lower two surfaces 12, 13 without sliding cores.

By configuring the housing to have the shape as is in Embodiment 1 of the present invention, it is possible to form a portion to become a suction opening of the air, an attachment hole 18 for attachment of the blowing apparatus, a boss portion 16 to which a motor portion is to be fixed, a spoke portion 17 for supporting the boss portion 16, the air pocket portion 11 enabling improvement of the fan characteristics and the like with the use of a mold having much simpler configuration than the conventional case, thereby making it possible to improve the productivity and reduce the cost for the reason that it becomes possible to form such parts with smaller provision than the conventional case due to reduction of fabrication cost of the mold and size reduction of the mold and the like, as well as it is possible to realize the effects of stabilizing the production accuracy and simplifying the maintenance of the mold because of the simplification of the structure of the mold and reduction of number of movable portions.

Furthermore, by providing the housing of the present embodiment with the air pocket portion 11, and keeping the entire wall thickness nearly uniform, it becomes possible to improve the accuracy by suppressing a sink at the time of forming, as well as it becomes possible to reduce the weight and material cost by omitting the materials for needless portions.

EMBODIMENT 2

FIG. 6 show a housing of a blowing apparatus according to Embodiment 2 of the present invention. FIG. 6A is a side view, FIG. 6B is a front view, FIG. 6C is a section view and FIG. 6D is a detailed section view along the line X-X1 of the blowing apparatus.

Figure 7A:
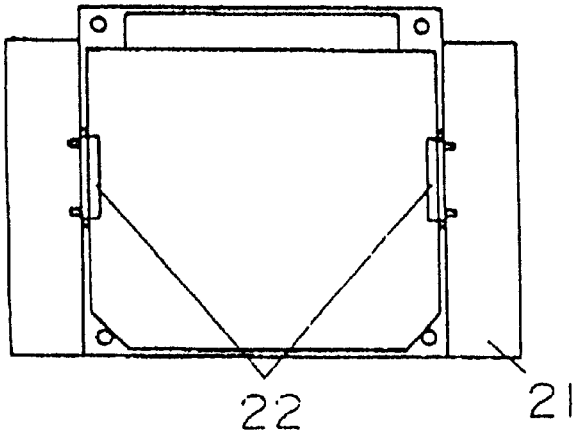
FIGS. 7A, 7B and 7C respectively show a front view, a side view and a top view of an attachment jig of the blowing apparatus.
Figure 7B:
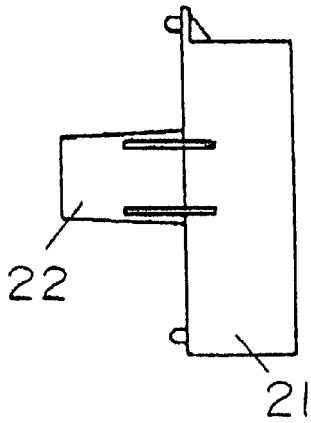
Figure 7C:
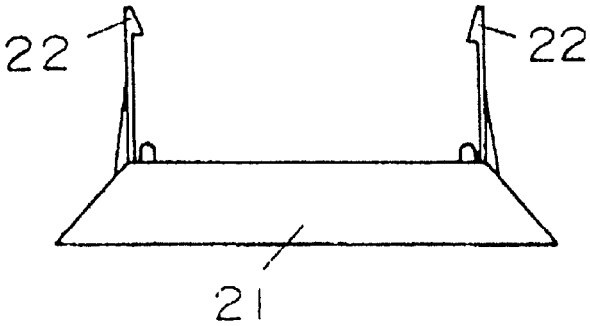

As shown in FIG. 6, the housing of Embodiment 2 of the present invention is characterized in that the spoke portion 17 supporting the boss portion 16 to which a motor portion is to be fixed is fixed on the circular wall, and is not directly fixed to the housing outer peripheral portion 10 or the motor attachment hole 18. Other portions have the same shapes as those of the housing of Embodiment 1. FIG. 7 show an attachment jig. FIG. 7A is a front view, FIG. 7B is a side view and FIG. 7C is a top view.

In fixing the blowing apparatus to the housing, it is common to use the fixing methods such as fixing with the use of a screw and the like using the attachment hole 18, and snap-in fixing system in which the housing outer peripheral portion 10 is fixed by using a attachment jig 21 of the blowing apparatus as shown in FIG. 7 and pushing the blowing apparatus using the spring property of a hook 22 without using a screw.

The blowing apparatus will not cause oscillation in the radial direction when fabricated at a perfect accuracy, however, actually parts and fans constituting the motor individually have errors, and when the motor rotates, unbalance oscillation having a cycle corresponding to the rotation number is induced by an unbalance of such errors.

In the case of the blowing apparatus of conventional or Embodiment 1 of the present invention, the motor is directly connected to the attachment hole which is an attachment portion of the motor or the housing outer peripheral portion via the spoke, so that the oscillation generated at the motor portion is directly transmitted to the housing.

To the contrary, in Embodiment 2 of the present invention, by fixing the spoke to the fixing portion indirectly via the circular wall, the motor portion is elastically supported with respect to the fixing portion, with the result that even when there is an unbalanced oscillation of a certain degree in the motor, the oscillation is transmitted while being attenuated, and resonance and the like of the housing to which the blowing apparatus is attached will not occur, and hence it is possible to suppress the noise and oscillation of the entire housing.

By the way, in order to reliably attenuate the oscillation, it is desired that the natural frequency of this oscillation system is lower than the rotation number of the motor which is a basic element of the excitation frequency of the motor.

Figure 8A:
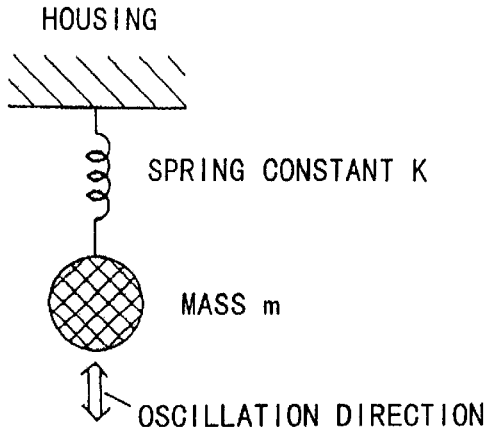
FIGS. 8A and 8B respectively show an oscillation system schematic explanatory view, and an explanatory view showing relationship between oscillation frequency and amplitude.

In this connection, since the mass of the entire housing is much larger than that of the blowing apparatus, oscillation of the motor in the radial direction can be considered by using a simple model of the oscillation system of the simple harmonic motion as shown in FIG. 8 composed of the masses of the motor and fans which are oscillators and springs of the spoke and circular wall elastically supporting the oscillators.

The natural frequency F (Hz) of this oscillation system is represented by the expression of:

$$n > \frac{1}{2\pi}\sqrt{\frac{k}{m}}$$

in which total mass of the motor and fans which are oscillators is denoted by m (kg), spring constant between the boss portion and the attachment portion (ratio of reaction force with respect to radial displacement) is denoted by k (N/m).

Figure 8B:
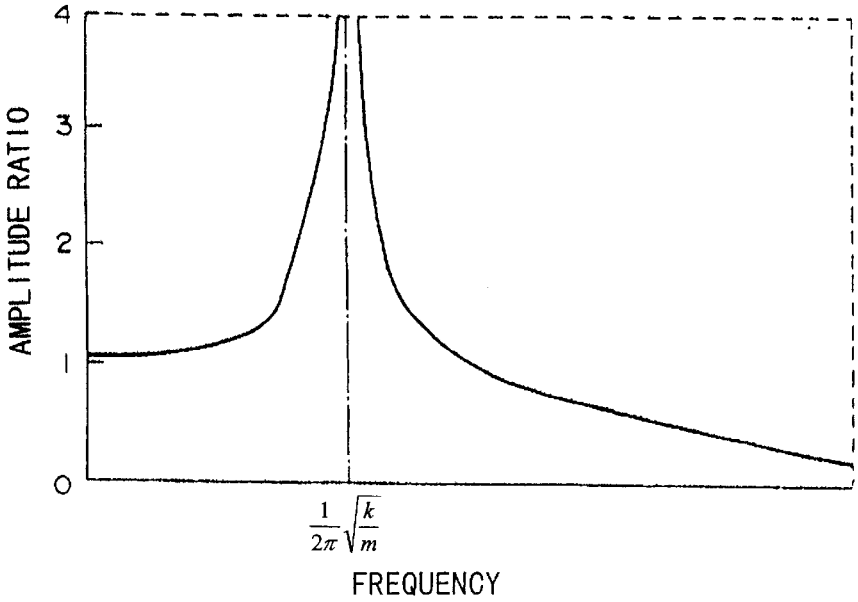
Figure 9A:
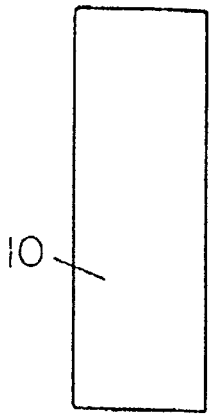
FIGS. 9A, 9B, 9C and 9D respectively show a side view, a front view, a section view and a detailed section view along line X-X1 of a housing of a blowing apparatus according to Embodiment 3 of the present invention.
Figure 9B:
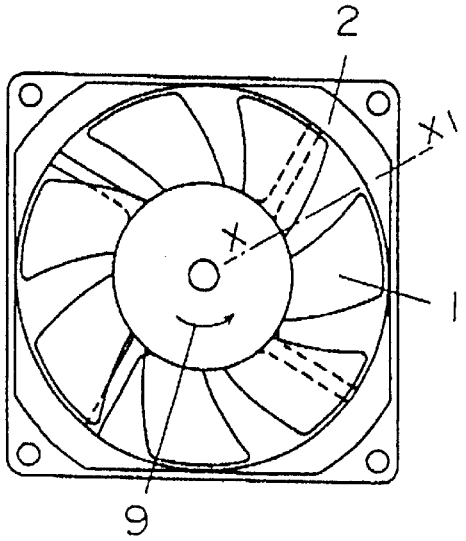
Figure 9C:
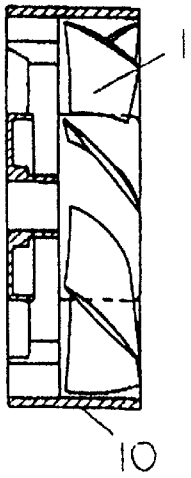
Figure 9D:
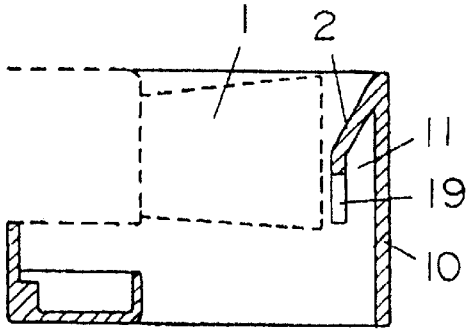

FIG. 8B is an explanatory view showing the frequency of external force exerted on the oscillation system and the ratio of the amplitude of the external force and the amplitude of the oscillation.

As shown in FIG. 8B, the amplitude of the oscillation shifts substantially following the external force when the frequency of the external force is low, however, the amplitude of the oscillation rapidly increases in the vicinity of the normal frequency F, and gradually decreases at frequencies higher than the normal frequency to converge to zero.

Therefore, by making the rotation number N (1/s) of the motor which is an excitation force lower than the normal frequency F, it is possible to further suppress the oscillation. In other words, by making a setting to satisfy the relationship:

$$n > \frac{1}{2\pi}\sqrt{\frac{k}{m}}$$

oscillation of the motor is transmitted to the housing after being attenuated, so that it is possible to suppress the oscillation of the housing and realize low noise and low oscillation.

Furthermore, by selecting the material of the housing from materials having relatively large damping force such as PBT (polybutyleneterephthalate) and PP (polypropylene), it becomes possible to attenuate the oscillation even at the time of motor startup and low speed rotation, and to improve the oscillation reduction effect.

EMBODIMENT 2

FIG. 9 show a housing of a blowing apparatus according to Embodiment 3 of the present invention. FIG. 9A is a side view, FIG. 9B is a front view, FIG. 9C is a section view and FIG. 9D is a detailed section view along the line X-X1 of the blowing apparatus.

In FIG. 9, the housing according to Embodiment 3 of the present invention is completely as same as that of Embodiment 1 other than that a plurality of slits 19 communicating with the inner circumference of the circular wall and the air pocket portion 11 and extending in the axial direction are formed in a part of the circular wall on the discharge side.

This slit 19 is useful for improving the characteristics when the blowing apparatus is used under the condition of particularly high static pressure.

Figure 10:
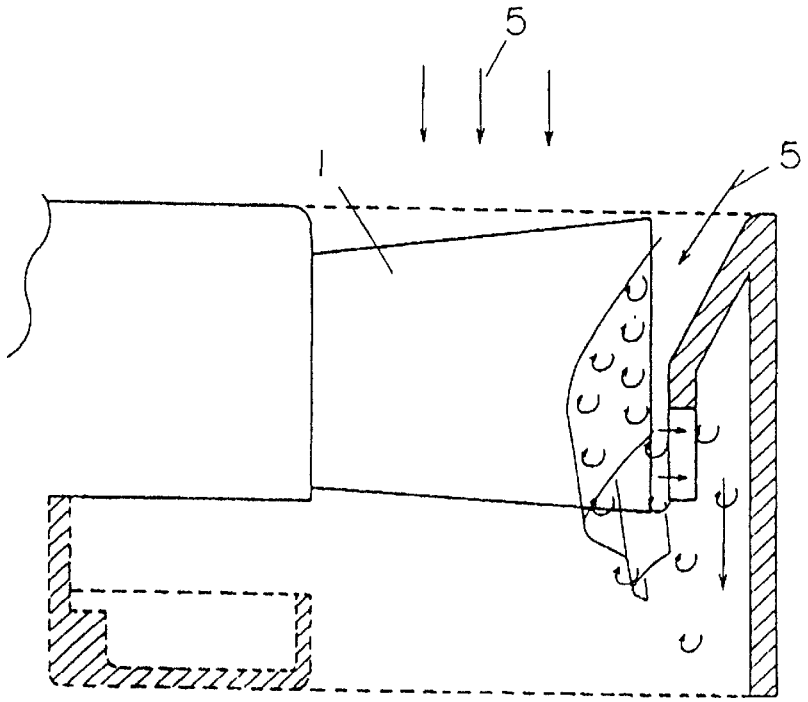
FIG. 10 is an explanatory view showing flow of air in the blowing apparatus according to the embodiment of the present invention.

FIG. 10 is an explanatory view showing flow of the air under the operation condition of the blowing apparatus according to Embodiment 3 of the present invention.

As shown in FIG. 10, the blade end vortex including the turbulent vortex 8 generated near the blade end is discharged out from the slit 19 to the air pocket portion, so that blade end vortex becomes unlikely to occur on the rotating fans. Accordingly, the end portion of the blade which has been inhibited from working by the blade end vortex can work satisfactorily, and thus the air capacity is increased.

Furthermore, as for the air flow including the turbulent vortex 8 discharged from the slit 19, since the air flow is discharged to the air pocket portion 11 after being straightened by the slit 19, and then attenuated in the space of the air pocket portion 11 to be discharged outside, the noise is reduced and the flow discharged from the slit 19 is effectively converted to the static pressure, so that it is possible to improve the static pressure efficiency of the fan.

Figure 11:
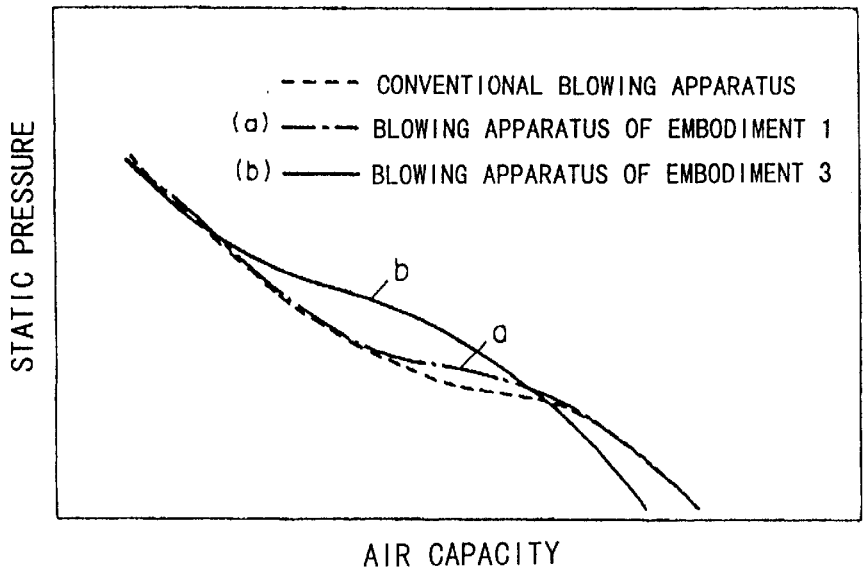
FIG. 11 is a view showing characteristics of the blowing apparatus according to the embodiment of the present invention in comparison with those of the conventional apparatus.
Figure 12:
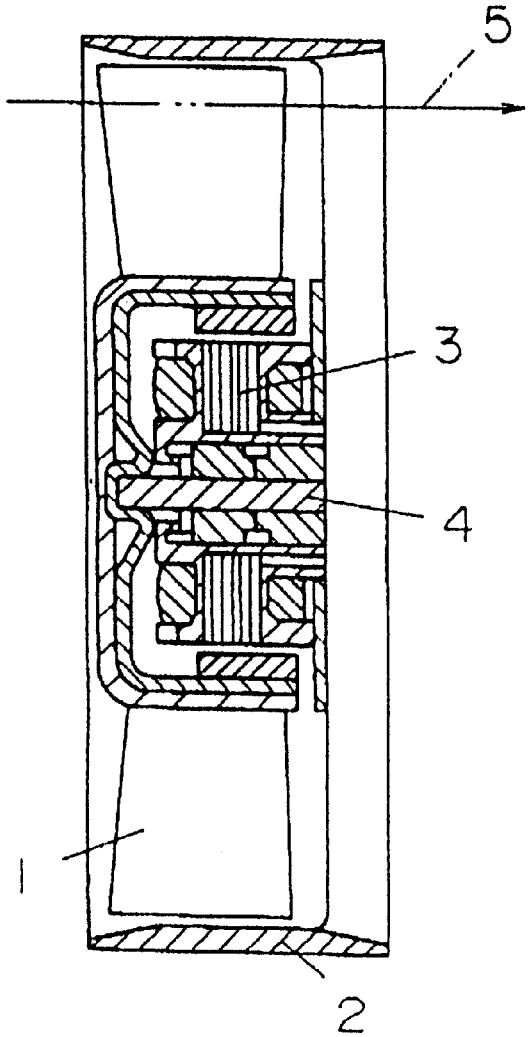
FIG.12 PRIOR ART
FIG. 12 is a section view of the conventional blowing apparatus.

FIG. 11 shows air capacity-static pressure characteristics of the present blowing apparatus in comparison with characteristics of the conventional blowing apparatus of the same size and characteristics of the blowing apparatuses according to Embodiments 1 and 3.

As is apparent from the curve (a) of FIG. 11, the blowing apparatus according to Embodiment 1 is excellent in the air capacity characteristic under the condition of relatively high pressure compared to the conventional blowing apparatus, however, the blowing apparatus according to Embodiment 3 of the present invention has more excellent air capacity characteristic. As a result of this, as shown in the curve (b) of FIG. 11, the blowing apparatus according to Embodiment 3 of the present invention is substantially improved in terms of the static pressure efficiency, so that it has significantly excellent performance under the condition of relatively high pressure.

On the other hand, under the operation condition of relatively low pressure, the air capacity of the blowing apparatus according to Embodiment 3 of the present invention is decreased. This is because as shown in the drawing, under the condition of low pressure, a remarkable vortex does not occur on the fans, while the air flow flowing into the inner circumference of the circular wall 2 from the slit 19 occurs, and the air flow circulating at the blade end occurs, with the result that the air capacity is decreased and energy loss due to the viscosity of the air occurs at the slit 19 to increase the fan driving force and deteriorate the static pressure efficiency of the fan.

Therefore, it is possible to obtain high cooling efficiency by using the housing according to Embodiment 1 or Embodiment 2 not having the slit 19 when the blowing apparatus is used under the condition of relatively low pressure for realizing the low noise, and by using the housing according to Embodiment 3 under the condition of relatively high pressure for improving the air blowing capability of the fan.

Furthermore, when used with being integrated into an appliance, the above blowing apparatus can be used at decreased rotation number of fan owing to the increased blowing capability, so that it is possible to obtain the effects such as reduction of energy consumption and noise reduction of the blowing apparatus, as well as the effect of improving the reliability is obtained. Alternatively, when used in conformance with the energy consumption, it is possible to obtain the effects of excellent blowing capability and improvement of the cooling property.

While there is no description about the forming method of the housing in the above Embodiments 2 and 3, it goes without saying that these housing can be formed by using a simple mold structure composed of only upper and lower cores as same as Embodiment 1.

What is claimed is:

1. A blowing apparatus comprising:

a circular wall at a distance from a blade end of a fan; and a housing comprising the circular wall integrally formed with a boss portion for fixing a motor, wherein the circular wall comprises a first region where an inner diameter varies from a smaller to a larger diameter so that a clearance with the blade end on a suction side is substantially wide, and a second region where a clearance with the blade end is substantially narrow, wherein the second region has a terminal end extending halfway on a discharge side, an air pocket portion having an opening toward the discharge side is between an outer circumference of the circular wall and an outer peripheral portion of the housing, the circular wall further comprises a slit for allowing air communication between the inner circumference of the circular wall and the air pocket portion, and the housing is formed by a mold comprising only upper and lower cores.

2. A blowing apparatus comprising:

a circular wall at a distance from a blade end of a fan; and a housing comprising the circular wall integrally formed with and a boss portion for fixing a motor, wherein a terminal end of the circular wall extends halfway on a discharge side, an air pocket portion having an opening toward the discharge side is between an outer circumference of the circular wall and an outer peripheral portion of the housing, and the housing is formed by a mold comprising only upper and lower cores.

3. The blowing apparatus according to claim 1, wherein the circular wall comprises a first region where an inner diameter varies from a smaller to a larger diameter so that a clearance with the blade end on a suction side is substantially wide, and a second region where a clearance with the blade end is substantially narrow.

4. The blowing apparatus according to claim 1, wherein the boss portion of the housing joins with the circular wall and is not directly fixed to the housing outer peripheral portion or to an attachment hole portion.

5. A blowing apparatus comprising:

a housing comprising:

a circular wall at a distance from a blade end of a fan;

a boss portion for fixing a motor; and a single unitary member, wherein the single unitary member is integral with the boss portion and the circular wall, a terminal end of the circular wall extends halfway on a discharge side, an air pocket portion having an opening toward the discharge side is between an outer circumference of the circular wall and an outer peripheral portion of the housing, and the housing is formed by a mold comprising only upper and lower cores.

6. The blowing apparatus according to claim 5, wherein the circular wall further comprises a first region where an inner diameter varies from a smaller to a larger diameter so that a clearance with the blade end on a suction side is substantially wide, and a second region where a clearance with the blade end is substantially narrow, wherein the second region has a terminal end extending halfway on a discharge side, an air pocket portion having an opening toward the discharge side is between an outer circumference of the circular wall and an outer peripheral portion of the housing, and the circular wall comprises a slit for allowing air communication between the inner circumference of the circular wall and the air pocket portion.

7. A blowing apparatus comprising a housing which comprises:

a first substantially cylindrical outer wall spaced radially adjacent a blade end of a fan;

a boss portion for holding a fan motor coaxially within said housing; and the boss portion, first cylindrical wall and members connecting same being an integral structure, with a second inner cylindrical wall portion extending axially from the air entrance end of the first cylindrical wall in the air discharge direction about one-half the axial length of the first cylindrical wall and spaced radially between said blade end and said first cylindrical wall, forming a volume between the outer and inner walls which volume opens toward the discharge side of the blowing apparatus, wherein the housing is formed by a mold comprising only upper and lower cores.

* * * * *